United States Patent [19]

Mullay et al.

[11] Patent Number: 4,933,028

[45] Date of Patent: Jun. 12, 1990

[54] HIGH EMULSIFIER CONTENT EXPLOSIVES

[75] Inventors: John J. Mullay, Hazelton; Joseph A. Sohara, Walnutport, both of Pa.

[73] Assignee: Atlas Powder Company, Dallas, Tex.

[21] Appl. No.: 374,276

[22] Filed: Jun. 30, 1989

[51] Int. Cl.[5] ..... C06B 45/00

[52] U.S. Cl. ..... 149/2; 149/21; 149/46; 149/60; 149/61; 149/92; 149/105; 149/93; 149/94; 149/95; 149/96; 149/98

[58] Field of Search ..... 149/2, 46, 21, 60, 61, 149/92, 105, 93, 94, 95, 96, 98

[56] References Cited

U.S. PATENT DOCUMENTS

| | | | |
|---|---|---|---|
| 3,447,978 | 6/1969 | Bluhm | 149/2 |
| 3,674,578 | 7/1972 | Cattermole et al. | 149/2 |
| 3,706,607 | 12/1972 | Chrisp | 149/2 |
| 3,711,345 | 1/1973 | Tomic | 149/22 |
| 3,715,247 | 2/1973 | Wade | 149/21 |
| 3,765,964 | 10/1973 | Wade | 149/2 |
| 4,141,767 | 2/1979 | Sudweeks et al. | 149/2 |
| 4,482,403 | 11/1984 | Takeuchi et al. | 149/2 |
| 4,543,137 | 9/1985 | Edamura et al. | 149/21 |
| 4,554,032 | 11/1985 | Hattori et al. | 149/21 |
| 4,708,753 | 11/1987 | Forsberg | 149/2 |
| 4,732,626 | 3/1988 | Edamura et al. | 149/21 |

*Primary Examiner*—Stephen J. Lechert, Jr.
*Attorney, Agent, or Firm*—Richards, Medlock & Andrews

[57] ABSTRACT

The present invention relates to water-in-oil emulsion explosive compositions comprising a discontinuous aqueous phase, a continuous water-immiscible organic phase, and an emulsifier content being at least 45% by weight of the emulsified fuel phase which decreases precompression or dead pressing.

17 Claims, No Drawings

HIGH EMULSIFIER CONTENT EXPLOSIVES

TECHNICAL FIELD

This invention relates to water-in-oil explosive compositions and more particularly to a water-in-oil emulsion explosive composition having a high emulsifier content which resists dead pressing while maintaining acceptable explosive properties.

BACKGROUND OF THE INVENTION

The invention relates to water-in-oil emulsion type blasting agents exemplified by Bluhm, U.S. Pat. No. 3,447,978, which have many advantages over conventional slurry blasting compositions, dynamites, ANFO, and aqueous gelled explosives. The emulsion explosive compositions of Bluhm now in common use in the industry have the following components; (a) a discontinuous aqueous phase comprising discrete droplets of an aqueous solution of inorganic oxygen-releasing salts; (b) a continuous water-immiscible organic phase throughout which the droplets are dispersed; (c) an emulsifier which forms an emulsion of the droplets of oxidizer salt solution throughout the continuous organic phase; and (d) a discontinuous gaseous phase.

Water-in-oil emulsion explosive compositions require uniformly dispersed void spaces provided by gas bubbles or a void-providing agent to obtain explosive performance. Therefore, maintaining the uniformly dispersed void spaces in the water-in-oil emulsion explosive is important in achieving good detonation performance and good shelf life. Furthermore, the manner in which void spaces are treated may affect the explosive properties of the emulsion explosive.

Void spaces can be provided by gas bubbles which are mechanically or physically mixed or blown into an emulsion explosive. Voids can also be formed in an emulsion explosive by a chemical gassing agent, or mixed into an emulsion explosive by a void-providing agent, such as hollow microspheres, expanded perlite or styrofoam beads.

A disadvantage of air or gas bubbles results from the fact that they are compressible under high pressures. If subjected to high pressure and compressed, the overall density of the emulsion explosive composition is increased and the composition is no longer detonable and desired explosive performance is reduced. The above phenomenon of density increase and desensitization of an explosive composition is known as precompression or dead pressing. Of course, hollow microspheres of resin or glass can withstand higher pressures than gas or air bubbles, but they too have a critical point of pressure at which they collapse and density reduction takes place.

Emulsion explosive compositions employing hollow microspheres or gas/air bubbles are particularly vulnerable to dead pressing in large blasting applications where holes in a blast pattern are detonated at varying time sequences. An undetonated borehole loaded with an emulsion explosive composition with hollow microspheres can experience dead pressing resulting from a desensitizing shockwave from an adjacent previously fired borehole. The impact of the adjacent charge compresses the undetonated charge, thus increasing its density to the point where it becomes undetonable (i.e., will not detonate reliably using a No. 8 cap).

To overcome the above phenomenon, it has been suggested in U.S. Pat. No. 4,474,628 that one should use stronger hollow microspheres which can withstand greater hydrostatic pressures and thus remain detonable. This suggested solution is both costly and can cause emulsion breakdown problems.

SUMMARY OF THE INVENTION

The explosive emulsion composition of the present invention provides an emulsion composition which has an emulsifier content which makes up at least 45% and preferably more than 60% of the total emulsified fuel component. Total fuel refers to the total weight of emulsifier and water immiscible carbonaceous fuels. It has been found that surprisingly the use of higher amounts of emulsifier than taught in the prior art leads to a definite improvement in the resistance of emulsion explosive products to precompression or dead pressing.

DETAILED DESCRIPTION

In the preferred embodiment of the present invention the emulsion has the general formula (all percentages herein are of total emulsion weight percents).

| COMPONENT | WEIGHT PERCENT |
|---|---|
| Oxidizer salts (nitrates, perchlorite) | greater than about 70% |
| Water | about 4 to about 20% |
| Sensitizers | 0 to about 40% |
| Additional fuels, densifiers | 0 to about 50% |
| Density reducing agent sufficient to render the composition detonable | 0 to about 6% |
| Total emulsified fuel | about 4 to about 10% |
| a. Water immiscible, emulsifiable, carbonaceous fuel component | about 0 to about 6% |
| b. Emulsifier | greater than 1.8 to about 10% of the total and above 45% of the total emulsified fuel |

The emulsifier component useful in the practice of the present invention includes any emulsifier which is effective to form a water-in-oil emulsion. Emulisifers effective to form a water-in-oil emulsion are well known in the art. Examples are disclosed in U.S. Pat. Nos. 3,447,978; 3,715,247; 3,765,964; and 4,141,767, the disclosure of which are hereby incorporated by reference. In addition, acceptable emulsifiers can be found in the reference work McCutheon's Emulsifiers and Detergents (McCutheon Division, M.C. Publishing Co., New Jersey). Specific emulsifiers that can be used include those derivable from sorbitol by esterification with removal of water. Such sorbitan emulsifying agents may include sorbitan fatty acid esters such as sorbitan monolaurate, sorbitan monooleate, sorbitan monopalmitate, sorbitan monostearate and sorbitan tristearate. The mono- and di-glycerides of fat-forming fatty acids are also useful as emulsifying agents. Other emulsifying agents which may be used in the present invention include polyoxyethylene sorbitol esters such as the polyoxyethylene sorbitol bees wax derivative materials. Water-in-oil type emulsifying agents such as the isopropyl esters of lanolin fatty acids may also prove useful as may mixtures of higher molecular alcohols and wax esters. Various other specific examples of water-in-oil type emulsifying agents include polyoxyethylene lauryl ether, polyoxyethylene oleyl ether, polyoxyethylene sterol ether, polyoxyoctylene and oleyl laureate, oleyl acid phosphates, substituted oxazolines and phosphate esters, to list but a few. Further, emulsifiers derivable from the esterification of mono- or polyhydric aliphatic alcohols by reaction with olefin substituted succinic acids are useful in practice of the present invention. Also, emulsifiers derivable from the addition of polyalkyline amine to a polyalkyline-substituted succinic acid are also useful in the present invention. Substituted saturated and unsaturated oxozalines. Mixtures of these various emulsifying agents as well as other emulsifying agents may also be used.

The liquid organic water-immiscible carbonaceous fuel is a fuel which is flowable to produce the continuous phase of an emulsion. The liquid carbonaceous (organic) fuel component can include most hydrocarbons, for example, paraffinic, olefinic, naphthenic, aromatic, saturated or unsaturated hydrocarbons. Suitable water-immiscible organic fuels include diesel fuel oil, mineral oil, paraffinic waxes, microcrystalline waxes, and mixtures of oil and waxes. Preferably, the organic water-immiscible fuel is diesel fuel oil because it is inexpensive and has a relatively low viscosity. Suitable oils useful in the compositions of the present invention include the various petroleum oils, vegetable oils, and mineral oils, e.g., a highly refined white mineral oil sold by White's Chemical Company, Inc. under trade designation of KAYDOL ® and the like. Waxes are preferably used in combination with oils and generally heating is required in order to dissolve the wax and oil together. Utilization of wax typically results in an emulsion which is more viscous than when mineral oil or diesel fuel oil or other light hydrocarbon oil is used. Suitable waxes such as petroleum wax, microcrystalline wax, paraffin wax, mineral waxes such as oxocerite and montan wax, animal waxes such as spermacetic wax and insect waxes such as bees wax and Chinese wax can be used in accordance with the present invention.

The emulsified fuel component can be made entirely of emulsifier, or a mixture of emulsifier and water-immiscible fuels having 45% or more emulsifiers. In the preferred embodiment, a mixture of immiscible carbonaceous fuel and emulsifier is preferred such that the emulsifier is from 60 to about 80% of the total weight of the emulsified fuel. In the past, emulsifier content was kept to a minimum for economic reasons, because the emulsifier is usually the most expensive ingredient or one of the most expensive ingredients. A slight excess of emulsifier above the minimum needed to form the emulsion was used because it helped maintain stability. It has now been discovered that very high emulsifier content surprisingly produces an emulsion which resists dead-pressing.

Preferably the density reduction is achieved by using density reducing agents. Most preferably the density is reduced using glass or resin microballoons. Typically, the density of the explosive composition should be from about 0.9 g/cc to 1.45 g/cc and most preferably from about 1.0 g to about 1.4 g/cc.

Additional fuels can be those known in the art such as finely divided coal, aluminum flakes, aluminum granules, ferrophosphorus, sugar, silicon, magnesium and sulfur. Generally, any of the fuels known in the art can be used.

Sensitizers suitable for use with the present invention include monomethylamine nitrate, TNT, PETN, smokeless powder, and others known in the art. Sensitizers are employed to increase sensitivity to detonation but usually will not be added because they are expensive.

The emulsion is rendered detonable by distributing therethrough substantially uniformly dispersed void spaced. Density reducing agents may be added to reduce density. The density may be reduced to the desired level by voids in the form of gas bubbles or density reducing agents or combination of both. These density reducing agents also serve to sensitize the total composition. Any suitable density reducing agent may be used including those known in the art such as glass or resin microballoons, styrofoam beads, perlite, and expanded perlite. The density reducing agent can also be occluded gas which is retained in the emulsion and is either whipped into the emulsion or generated by use of gassing agents such as thiourea together with sodium nitrite. The preferred embodiment utilizes microballoons as the density reducing agents.

The discontinuous phase is composed of an emulsified aqueous inorganic oxidizer salt solution. Oxidizer salts suitable for use with the present invention include ammonium nitrate, sodium nitrate, and calcium nitrate. Of course, these oxidizer salts can be utilized in combination with ammonium nitrate.

The precompression resistance of the explosive compositions of the present invention were measured using a specialized laboratory scale method. In this test a donor charge (a No. 8 cap and prime unit containing two grams of PETN) and a receiver cartridge ($1\frac{1}{4}'' \times 7''$ paper cartridge containing the test explosive material) were placed under water at a known distance from each other. The receiver cartridge was primed with a No. 8 blasting cap which was delayed 75 milliseconds from the donor cap. In several instances, the receiver cartridge was not detonated so that the cartridge could be retrieved and inspected. In most cases, however, initiation was attempted in the receiver cartridge. Detonation results were determined either by inspection or detonation velocity measurements or both. Of course, the smaller the distance between donor and receiver cartridges in which the receiver will remain detonable, the more precompression resistant the formula is. This test is used because it allows the evaluation of many samples, and it appears to adequately represent field effects, and it is reproducible. Table 1 contains examples of the usefulness of this invention.

Examples I–IV illustrate the effect of raising the emulsifier level on the resistance of the emulsion to dead pressing or precompression after being shocked. Example III represents a typical prior art composition. In all four cases, the test cartridge was placed 6" from the donor charge in the above test. After firing the donor, the receiver cartridge was not detonated but was retrieved and examined. In each case, the original emulsion explosive had a soft, pliable consistency prior to testing. This is indicative of an intact emulsion. Results of past test inspection are given in the table. It can be seen that the higher emulsifier level products retain their soft consistency while the lower levels became hard. This latter result is indicative of a broken emulsion. Thus, higher emulsifier levels improve resistance to shock degradation.

Examples V–VII illustrate the effect of emulsifier content on detonation properties. As above, the test cartridge was placed 6" from the donor charge. In these cases, however, the receiver was initiated. Results are given in the table. It is readily apparent that increasing the emulsifier level also increases the ability of the product to remain detonable after being shocked. This is a very important attribute for explosive products.

The last two examples illustrate the same phenomenon. The data shows that as the percent of the emulsifier is increased the resistance to shock is increased. It can also be seen from the results in the table that different emulsifiers or a combination of emulsifiers can be used to give the improved performance.

TABLE

COMPOSITIONS OF MIXES (EXPRESSED IN WEIGHT PERCENT) OFFERED AS EXAMPLES OF THE PRESENT INVENTION

| Ingredient | I | II | III | IV | V | VI | VII | VIII | IX |
|---|---|---|---|---|---|---|---|---|---|
| Ammonium Nitrate | 72.8 | 72.8 | 72.8 | 72.8 | 72.8 | 72.8 | 72.8 | 72.8 | 72.8 |
| Sodium Nitrate | 10.0 | 10.0 | 10.0 | 10.0 | 10.0 | 10.0 | 10.0 | 10.0 | 10.0 |
| Water | 10.0 | 10.0 | 10.0 | 10.0 | 10.0 | 10.0 | 10.0 | 10.0 | 10.0 |
| Microcrystalline Wax | — | — | — | — | .38 | .3 | .2 | 1.3 | .9 |
| Paraffin Wax | — | — | — | — | .38 | .3 | .2 | 1.3 | .9 |
| Mineral Oil | 2.6 | 1.65 | 3.5 | 1.64 | 2.27 | 2.0 | 1.25 | 0.9 | .6 |
| Glass Microballoons (C25/250) | 2.5 | 2.5 | 2.5 | 2.5 | 2.5 | 2.5 | 2.5 | 2.5 | 2.5 |
| Sorbitan Monooleate | 2.1 | 3.05 | 0.6 | 1.53 | — | — | — | 1.1 | 2.2 |
| Emulsifier 1[a] | — | — | 0.6 | 1.53 | — | — | — | — | — |
| Emulsifier 2[b] | — | — | — | — | 1.65 | 2.1 | 3.05 | — | — |
| Density (g/cc) | — | 1.11 | 1.12 | 1.14 | 1.10 | 1.10 | 1.10 | 1.10 | 1.10 |
| Precompression[c] | Hard | Soft | Hard | Soft | F | P | D | [d]3310 (12) | [e]3460 (10) |
| Testing Result Distance (inches)[f] | 6 | 6 | 6 | 6 | 6 | 6 | 6 | F10 | F8 |
| % Emulsifier in Fuel | 45 | 65 | 25.5 | 65 | 35 | 45 | 65 | 39 | 48 |

[a]Found by the addition of polyalkyline amine to a polyalkyline-substitued succinic acid, sold as OLOA-1200 Chevron.

[b]Found by the esterfication of mono or polyhydric allphatic alcohols by reaction with olefin substituted succinic acids, sold as Zubribol.

[c]Hard and soft indicates the texture of emulsion receiver charges which were in the water but not detonated.

[d]Is the velocity of detonation m/sec of a receiver charge 12 inches from the donor charge detonated.

[e]Indicates a detonation velocity m/sec of the receiver charge 10 inches from the donor charge initially detonated.

[f]Reports distance of the receiver charge from the initially detonated donor charge. F10 indicates the receiver charge failed to detonate when placed 10 inches from the donor charge. F8 indicates the failure to detonate when the receiver charge was placed 8 inches from the donor charge.

We claim:

1. A water-in-oil explosive composition comprising:
(a) an emulsified water immiscible liquid carbonaceous fuel as a continuous phase;
(b) an aqueous inorganic oxidizer salt solution as a discontinuous phase;
(c) a density reducing agent; and
(d) an emulsifier which makes up at least about 60% of said emulsified carbonaceous fuel phase.

2. The explosive composition of claim 1, wherein said water immiscible carbonaceous fuel is selected from the group consisting of diesel fuel oil, mineral oil, paraffinic waxes, microcrystalline waxes and mixtures thereof.

3. The explosive composition of claim 1, wherein said inorganic oxidizer salt is selected from the group consisting of ammonium nitrate, sodium nitrate, calcium nitrate and mixtures thereof.

4. The explosive composition of claim 1, wherein said density reducing agent is selected from the group consisting of gas bubbles, air bubbles, perlite, expanded perlite, styrofoam beads, and hollow microspheres.

5. The explosive composition of claim 1, wherein said emulsifier is selected from the group consisting of emulsifiers derivable from esterification of sorbitol, esterification of mono- and polyhydric aliphatic alcohols by reaction with olefin-substituted succinic acids, and emulsifiers derivable from the addition of polyalkyline amine to a polyalkyline-substituted succinic acid.

6. The explosive composition of claim 1, further comprising additional fuels, densifiers, and sensitizers.

7. The explosive composition of claim 1, wherein said emulsifier is at least about 65% of the emulsified carbonaceous fuel phase.

8. The explosive composition of claim 7, wherein said density reducing agents are microballoons.

9. An emulsion explosive composition comprising:
(a) water from about 4 to about 20% by weight of the total composition;
(b) oxidizer salts from above about 70% by weight of of the total composition dissolved in said water which solution forms the continuous emulsion phase;
(c) sensitizers from 0 to about 40% by weight of the total composition;
(d) a water immiscible emulsified fuel component from about 4% to about 10% by weight of the total composition comprising 0 to about 6% by total weight of the total composition of a water immiscible carbonaceous fuel and 1.8 to about 10% by weight of total composition of emulsifier and said emulsifier content being at least about 60% by weight of the water immiscible emulsifiable fuel component;
(e) sufficient occluded void spaces to render the composition detonable; and
(f) from 0% to about 40% by total weight of a sensitizer.

10. The explosive composition of claim 9, wherein said water immiscible liquid organic fuel is selected from the group consisting of diesel fuel oil, mineral oil, paraffinic waxes, microcrystalline waxes and mixtures thereof.

11. The explosive composition of claim 9, wherein said inorganic oxidizer salt is selected from the group consisting of ammonium nitrate, sodium nitrate, calcium nitrate and mixtures thereof.

12. The explosive composition of claim 9, wherein said void spaces are provided by density reducing agents selected from the group consisting of gas bubbles, air bubbles, perlite, expanded perlite, styrofoam beads, and hollow microspheres.

13. The explosive composition of claim 9, wherein said emulsifier is selected from the group consisting of emulsifiers derivable from esterification of sorbitol, esterification of mono- and polyhydric aliphatic alcohols by reaction with olefin-substituted succinic acids, and emulsifiers derivable from the addition of polyalkyline amine to a polyalkyline-substituted succinic acid.

14. The explosive composition of claim 9, wherein said sensitizers are selected from the group consisting of monomethylamine nitrate, trinitrotoluene, pentaerythritoltetranitrate and smokeless powder.

15. The explosive composition of claim 9, wherein said void spaces are provided by glass microballoons.

16. The explosive composition of claim 9, wherein the density of the composition is from about 0.9 g/cc to 1.45 g/cc.

17. The explosive composition of claim 15, wherein the density is from about 1.0 g/cc to about 1.4 g/cc.

* * * * *

UNITED STATES PATENT AND TRADEMARK OFFICE

CERTIFICATE OF CORRECTION

PATENT NO. : 4,933,028

DATED : June 12, 1990

INVENTOR(S) : Mullay, et al.

It is certified that error appears in the above-identified patent and that said Letters Patent is hereby corrected as shown below:

Column 3, line 10, delete ". Mixtures" and insert therefore --and mixtures--.

Column 4, line 5, delete "spaced" and insert therefore --spaces--.

Column 5, footnote b of Table, delete "allphatic" and insert therefore --aliphatic--.

Column 5, footnote b of Table, delete "esterfication" and insert therefore --esterification--.

Column 8, lines 1 and 2, delete " trinitrotoluene, pentaerythritoltetranitrate" and insert therefore --TNT, PETN--.

Signed and Sealed this

Fourteenth Day of January, 1992

*Attest:*

*Attesting Officer*

HARRY F. MANBECK, JR.

*Commissioner of Patents and Trademarks*